United States Patent [19]

Friedlander

[11] 4,058,761

[45] Nov. 15, 1977

[54] SATURATED REACTORS

[75] Inventor: Erich Siegfried Friedlander, Birmingham, England

[73] Assignee: Associated Electrical Industries Limited, London, England

[21] Appl. No.: 683,089

[22] Filed: May 4, 1976

[30] Foreign Application Priority Data

May 13, 1975 United Kingdom ..... 20110/75

[51] Int. Cl.[2] ..... G05F 3/06

[52] U.S. Cl. ..... 323/48; 323/56; 323/60; 323/83; 323/89 C

[58] Field of Search ..... 323/44, 47, 48, 50, 323/53, 56, 54, 57, 83, 85, 89 C; 321/9, 68

[56] References Cited

U.S. PATENT DOCUMENTS

| | | | |
|---|---|---|---|
| 2,849,674 | 8/1958 | Biringer | 323/56 |
| 3,450,981 | 6/1969 | Fletcher et al. | 323/60 |
| 3,621,376 | 11/1971 | Friedlander et al. | 323/83 |

*Primary Examiner*—Gerald Goldberg
*Attorney, Agent, or Firm*—Kirschstein, Kirschstein, Ottinger & Frank

[57] ABSTRACT

A saturated reactor of the type, for example the treble-tripler reactor, in which groups of 3-phase windings are connected in series to produce multiple flux phases in respective core limbs to achieve harmonic compensation. The windings are connected between the line terminals and a star-point which cannot normally be earthed if large 3rd harmonic components are to be avoided. In this invention the zero-sequence impedance of the reactor is kept at a low value by duplicating the complete primary winding and connecting the two duplicates in zig-zag star. The resulting star point can then be earthed without upsetting the harmonic compensation of the reactor.

10 Claims, 12 Drawing Figures

SATURATED REACTORS

This invention relates to voltage stabilising arrangements for alternating current networks, of the kind which make use of saturated reactors for loading the network in order to compensate for voltage variations resulting from a fluctuating load, and is particularly concerned with voltage stabilising arrangements of this kind which incorporate means for suppressing self-generated harmonics.

For the purpose of the present invention, the saturated reactor arrangement has three line-terminals for connection to the supply system and includes *n* core-limbs, where *n* is at least five, there being *p* groups of said core-limbs where *n/p* is an integer, each group of said core-limbs having primary windings connected between said three line-terminals and a star-point, the primary windings of each group being connected in series with those of each other group if any, and in such manner that fluxes in the core-limbs have phases spaced regularly throughout each half cycle, the reactor arrangement further including a secondary winding on each of said *n* core-limbs which secondary windings are interconnected to form one or more mesh circuits. Such a saturated reactor arrangement will be referred to as being of the kind specified.

Saturated reactors of the harmonically-compensated type specified above are known from, for example, U.S. Pat. Nos. 3,450,981, 3,621,376 and others, using winding arrangements derived in part from the method employed in magnetic frequency multiplication as described in "Principles and analysis of a stabilised phase multiplier type of magnetic frequency convertor" by E. Friedlander, Electrical Energy, October 1956, Vol. 1, pp. 55–60.

Taking as an example a known type of treble-tripler saturated reactor involving a short circuited winding for 9th harmonic current, and such as described in the above patents, FIG. 1 of the accompanying drawing shows a physical arrangement of the magnetic core and windings in such a reactor, in diagrammatic form. The core comprises 9 limbs referenced 1-9 coupled with two common yokes 10 and 11. Each limb has either one or two primary windings, of turns $N_0$, $N_1$ or $N_2$ as shown. A secondary winding of $N_3$ turns is also used on each limb, interconnected to form a closed mesh with respect to the 9th harmonic but having terminals for the 3rd harmonic which preferably connected to an auxiliary saturated reactor (not shown) at terminals P, Q, R in a manner to improve harmonic compensation and flux shape in the cores, as described in the above-mentioned patents. The provision of a short circuit path for the 9th harmonic obviates the need for any additional return limb for 9th harmonic flux.

For the purposes of the present invention it is not essential that the core-limbs have no air gaps and they may therefore each be provided with one. They do however, operate in a saturated region.

FIG. 2 of the accompanying drawings shows an example of the interconnections between primary windings. In this diagram each primary winding is shown with its appropriate number of turns (with a minus sign to indicate a relatively reversed winding) and the encircled figures indicate the limb number referred to in FIG. 1. The windings are in three sets, labelled X, Y and Z respectively in FIG. 2.

In normal operation, terminals A, B, C are connected to a 3-phase balanced a.c. voltage supply and the "neutral" terminal D left isolated. The complete reactor draws current comprising a fundamental and harmonic components from each phase of the a.c. supply. By a suitable choice of relative turn numbers as described in the above references all harmonic components of current up to at least order 16 can be made zero in normal balanced operation.

The necessary directions of the interconnections between the primary windings, and their turn number proportions are illustrated in the vector diagram of FIG. 3 which shows how magnetic fluxes in the nine limbs are obtained with successive phase displacements of 20°, i.e. 180/9. Limbs 1, 4 and 7 have single windings connected in the respective phases A, B and C. The winding $N_0$ on limb 4 is, however, reversed (see FIG. 2) and consequently the limb 4 flux is reversed with respect to limbs 1 and 7, and the three fluxes are phased accordingly, 60° apart. Limb 2 has a flux resulting from a winding of $N_1$ turns connected in phase with phase A, and a winding of $N_2$ turns connected with phase opposite to phase C. The ampere turns due to windings $N_1$ and $N_2$ are represented by the vectors shown, in relation to the number of turns $N_0$. Limb 3, in similar manner, has a flux determined by a winding of $N_1$ turns in opposition to phase C and a winding of $N_2$ turns in phase with phase A. The remaining fluxes are determined similarly, each having a phase advanced by 20° from the preceding one.

All parallel vectors in FIG. 3 are consequently shown in the same winding set, X, Y or Z, i.e. on the same phase, in FIG. 2.

The basic reactor of FIGS. 1 and 2 is known as a treble-tripler because it incorporates three reactor groups each of which produces triple-frequency voltages in its secondary mesh winding group. The three groups are connected in series, as described for example in the above patent or as can be seen from FIGS. 2 and 3. The groups comprise limbs 1, 4 and 7; 2, 5 and 8; and 3, 6 and 9. From FIG. 3 it can be seen that each of these three groups has limb fluxes spaced at 60°, the phases of the group fluxes then being interlaced to give the 20° spacing. Relating the basic reactor of FIG. 1 to the type specified above, *n* is clearly nine, and *p*, the number of reactor (or limb) groups, is three.

In the basic reactor of FIG. 1 the fundamental components of current form a positive-sequence system and typically have a relationship to applied voltage as shown in curve EFO of FIG. 4.

If the star-point, i.e. terminal D of the reactor of FIG. 1 is left isolated, the zero-sequence impedance of the reactor is clearly infinite. Direct earthing of terminal D to the a.c. system neutral will cause large components of 3rd harmonic current in all connections, and is not normally permissible. In particular reference to the treble-tripler, an alternative neutral earthing means is described in the above U.S. Pat. No. 3,621,376 in which a portion of the mesh winding of appropriate number of turns is connected between point D and the a.c. system neutral; this substantially eliminates neutral currents at 3rd and other orders, but for balanced system conditions only; the overall zero-sequence impedance at fundamental frequency is insufficiently low for some purposes.

It is the object of this invention to provide modified winding arrangements in any harmonically-compensated saturated reactor of the kind specified to provide a terminal suitable for connection to an a.c. system neutral or to earth and in which harmonic compensation in the modified reactor is unaffected by current in the neutral connection, as a result of low zero-sequence impedance of the reactor.

According to the present invention, in a saturated reactor arrangement of the kind specified the primary winding arrangement is duplicated on the core-limbs and the two duplicates are connected in zig-zag star connection between the three line terminals and said star-point, the arrangement being such that zero-sequence current causes negligible magnetisation of any core-limb so that said star-point can be earthed in operation without reducing the harmonic compensation provided by the reactor arrangement. Third harmonic currents and a high impedance in the connection to earth are thus avoided. A compensating saturated reactor is preferably connected to the mesh circuit or mesh circuits to extend the range of harmonic currents which can be suppressed.

Primary windings of the two duplicates which are on the same supply phase and on the same core-limb may be combined in a single winding. The core-limbs may or may not have air gaps.

The star point may be connected to a neutral terminal by means of a reactor or resistor to limit earth fault currents of a supply system when the neutral terminal is connected to earth or to the neutral of the supply system in operation.

A controllable 3-phase reactive voltage supply device may be connected between the three neutral ends of the primary windings and the star point whereby to bias the voltage level of the saturated reactor characteristic. The reactive voltage supply device may be a 3-phase transformer the ratio of which is adjustable by tap changer, or may be a synchronous compensator.

Alternatively, the reactive voltage supply device may be a further saturated reactor arrangement of the kind specified having a similar but smaller core construction and which is connected to the first saturated reactor by a transformer and tap changer.

A capacitor may be connected in series with each set of primary windings for modification of the effective saturated slope reactance. In such a case, the capacitor may be shortcircuited, for zero-sequence currents, by transformers, linear or saturable reactors, each having two windings connected in zig-zag between the phases.

A saturated reactor arrangement in accordance with the invention will now be described, by way of example, with reference to the accompanying drawings, of which:

Figure 1:
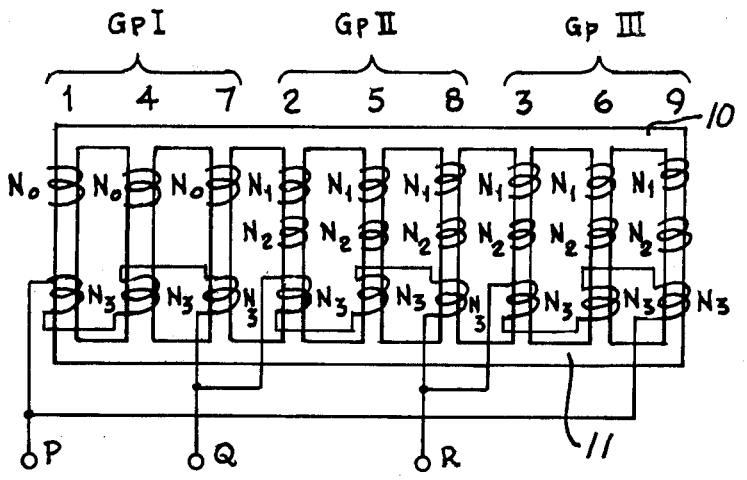
FIG.1. PRIOR ART
FIG. 1 is a diagram of the physical arrangement of a 'treble-tripler' saturated reactor.

Referring to the drawings, the known treble-tripler reactor has been described, as one example of the kind specified, with reference to FIGS. 1–4. The manner in which this known reactor is modified in accordance with the invention will be described with reference to these and the remaining Figures.

Figure 2:
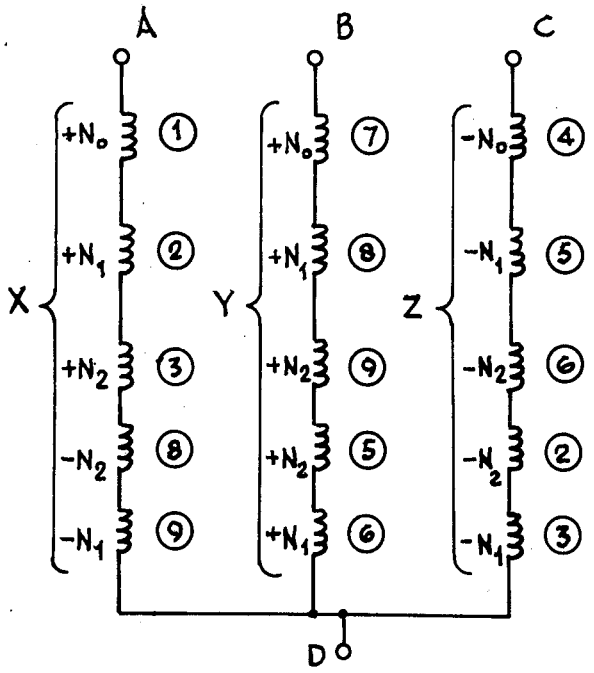
FIG.2. PRIOR ART
FIG. 2 is a diagram of the interconnections of the primary windings of the reactor of FIG. 1.
Figure 3:
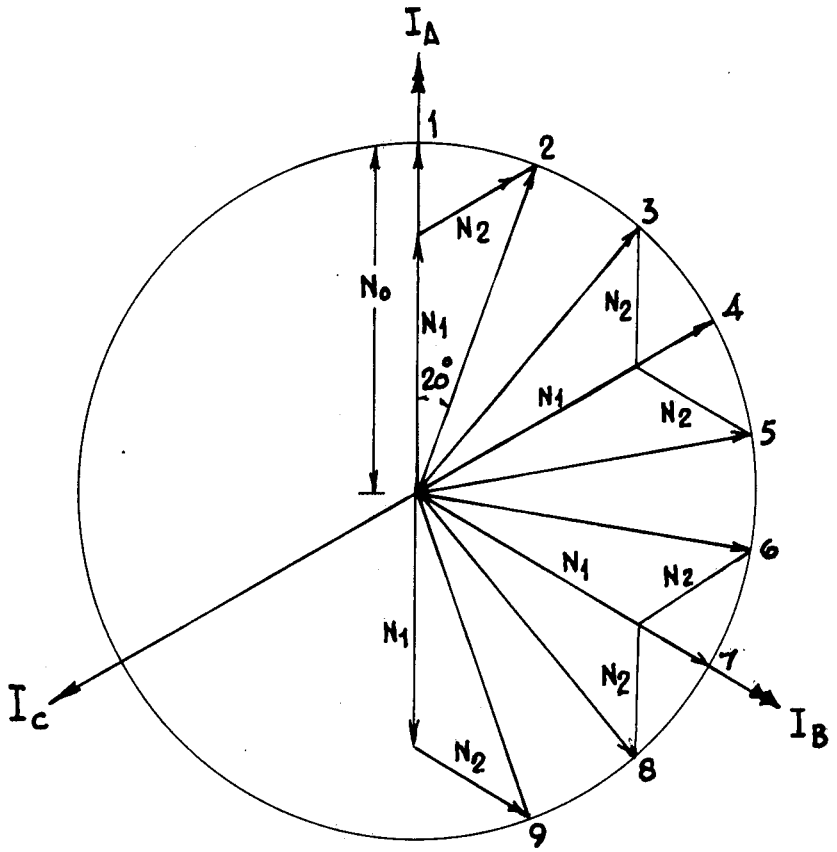
FIG. 3. PRIOR ART
FIG. 3 is a vector diagram of the magnetic fluxes in the reactor core limbs.
Figure 5:
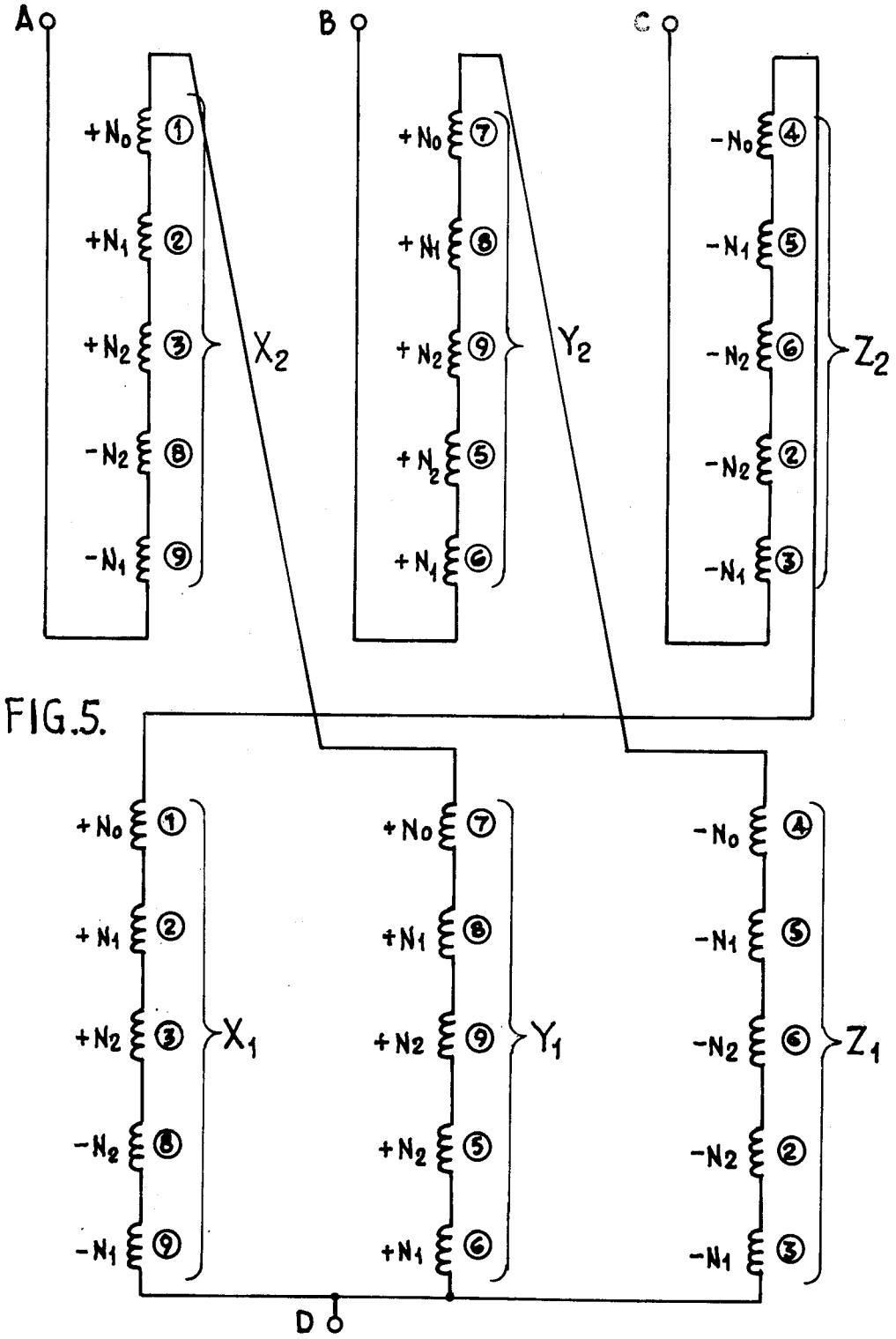
FIG. 5 is a diagram of a duplicate winding arrangement according to the invention.
Figure 6:
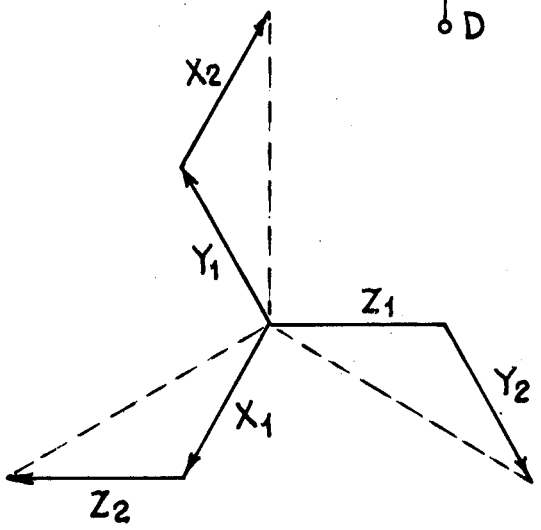
FIG. 6 is a vector diagram of the ampere turn components resulting from the winding arrangement of FIG. 5 in each pair of windings replacing one of the windings of FIG. 2.

The existing sets of primary windings, referenced in FIG. 2, X, Y and Z, are referenced $X_1$, $Y_1$ and $Z_1$ in FIG. 5. Each set of primary windings is then duplicated by the winding sets $X_2$, $Y_2$ and $Z_2$ distributed in identical manner throughout the nine limbs (as indicated by the circled numbers adjacent each winding). The two duplicate sets of primary windings are then connected in zig-zag star connection between the three line terminals A, B and C and the star-point terminal D. That is, each winding set, $X_1$, $Y_1$, $Z_1$ is connected in series with a corresponding winding set $Z_2$, $X_2$ or $Y_2$, each of the latter being completely reversed as shown in FIG. 5. With the same winding rating as for the reactor of FIG. 2, i.e. for the same volts/turn, the series connection of the two phase displaced sets will accommodate a phase voltage of only $\sqrt{3}$ times the original figure. The vector diagram for the voltages across the two sets of windings is illustrated in FIG. 6.

Figure 7:
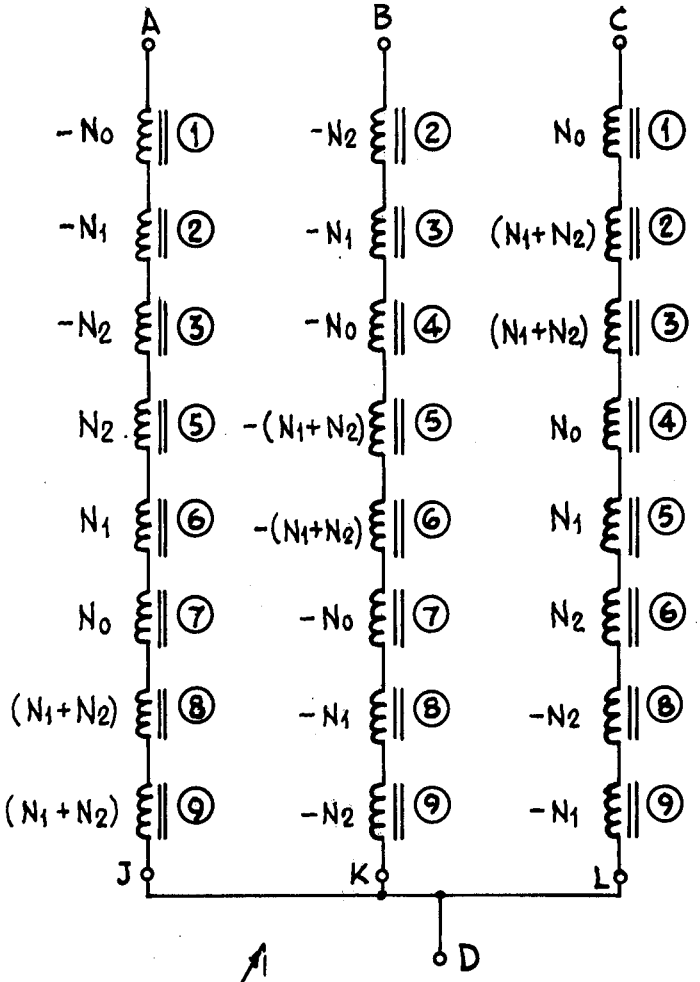
FIG. 7 shows a re-arrangement of the windings of FIG. 5 referred to their supply phases.

FIG. 7 shows the total primary winding connections, with indications of the number of turns and direction of each winding, the relevant limb number and the phase. Where, as a result of the duplication, two windings are on the same phase (i.e. in the same 'set') and on the same limb, they are combined, taking account of their directions, into a single winding. Such windings are shown with the sum of the turn numbers in brackets.

The secondary mesh windings are not shown in FIGS. 5 and 7. The mesh loading reactor previously referred to as connected to terminals P, Q and R in FIG. 1 may also be used in the arrangement of FIG. 5.

The sum of the main winding turns on all limbs is clearly increased by 2 in the simple duplicate, and, as mentioned above, the rated voltage of the reactor has increased by $\sqrt{3}$ times, relative to the prototype (i.e. FIG. 1). If desired, the voltage may be made the same as for the prototype by dividing all primary turn numbers by $\sqrt{3}$. The total number of turns is then $2/\sqrt{3}$ or 1.15 times that of the prototype, hence the necessary amount of copper is increased by this ratio (ignoring mesh windings). It follows that the arrangement of this invention will only be justified where the special advantages mentioned below are relevant.

The vector diagram of FIG. 6 corresponds to that of the well-known zig-zag earthing transformer, and the complete reactor behaves in a similar manner in presenting low reactance to zero-sequence voltage and current. This is because zero-sequence currents are equal and opposite in the pair of similar windings on any one limb so that the flux path for each winding lies substantially in air, and results in a flux component of negligible magnitude. For this reason the zero-sequence reactance will normally be lower even than the normal saturated slope reactance for positive-sequence current.

Since zero-sequence current causes no contribution to magnetic flux in the iron, it also follows that it cannot affect harmonic compensation; i.e. it does not cause currents of additional harmonic orders, nor does it affect the values of currents of order 17, 19, 35, 37 etc., which are therefore unchanged from those in the prototype of FIG. 2.

In the basic operation of the reactor arrangement, the star-point terminal D in FIG. 7 is connected to earth. The combination of a reactor according to the invention and a direct connection of the star-point to earth provides several advantages. A.C. system voltage will tend to be stabilised to some extent against the effects of single-phase load changes, perhaps assisted by reduction of saturated slope reactance by series capacitors (see below). Earthing of the reactor star-point terminal D provides effective earthing of the a.c. system even for cases where it is supplied from a delta winding on a main supply transformer, and may make possible the omission of a separate earthing transformer in distribution schemes. Where it is desired to limit current due to earth faults in the a.c. system, a resistor or reactor may be inserted in the connection from reactor neutral to earth.

Figure 8:
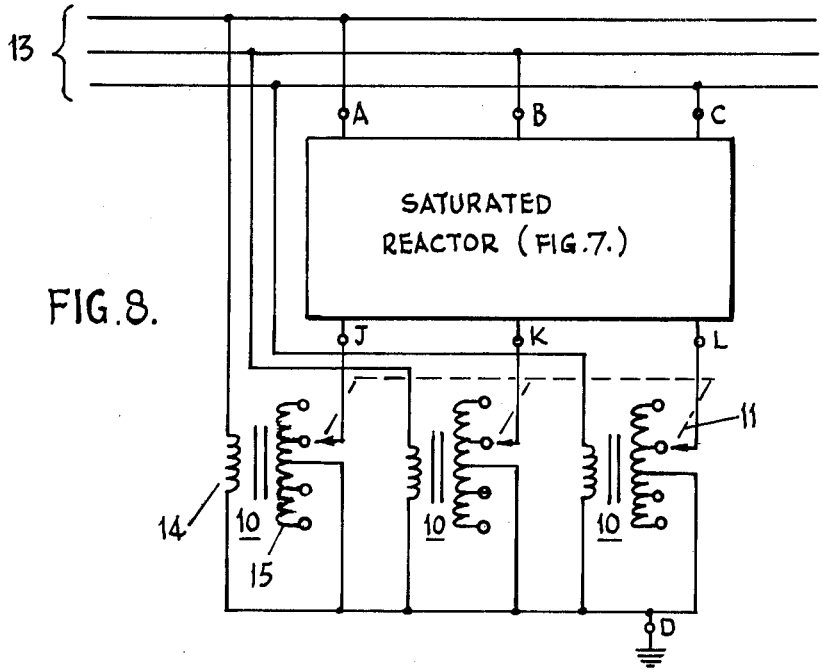
FIGS. 8–12 are circuit diagrams of modified applications of the invention.

In the characteristic EFO of FIG. 4 it is readily possible to change the saturated slope in the working region EF by using series capacitors (see below). However, change of the intercept voltage $E_0$ may also be required and is more convenient with the present invention, particularly on high voltage schemes, since it is readily possible to break the three internal connections (JKL in FIG. 7) to terminal D in the reactor and to insert variable 3-phase voltages of low value relative to earth. One means to achieve this is shown in FIG. 8, in which a 3-phase transformer 10 with primary windings 14 connected to the a.c. supply system busbars 13 is employed with secondary windings 15 connected, via a tapchanger 11, between the terminals JKL and earth. By making the tapchanger capable of reversing the effective secondary voltage the required rating of the transformer becomes relatively low, being for example 10% of the reactor rating if a variation of voltage of ± 10% is required.

Alternatively the three terminals JKL may be earthed via any form of 3-phase reactive voltage device which exhibits a back-e.m.f. One such device (not shown) is a conventional synchronous compensator, in which variation of its d.c. field causes its reactance to change from a positive value (voltage leading current) for a weak field to a negative value (voltage lagging current) for full field current, with corresponding variation of the intercept voltage $E_0$ and thus of the main a.c. system voltage.

Figure 9:
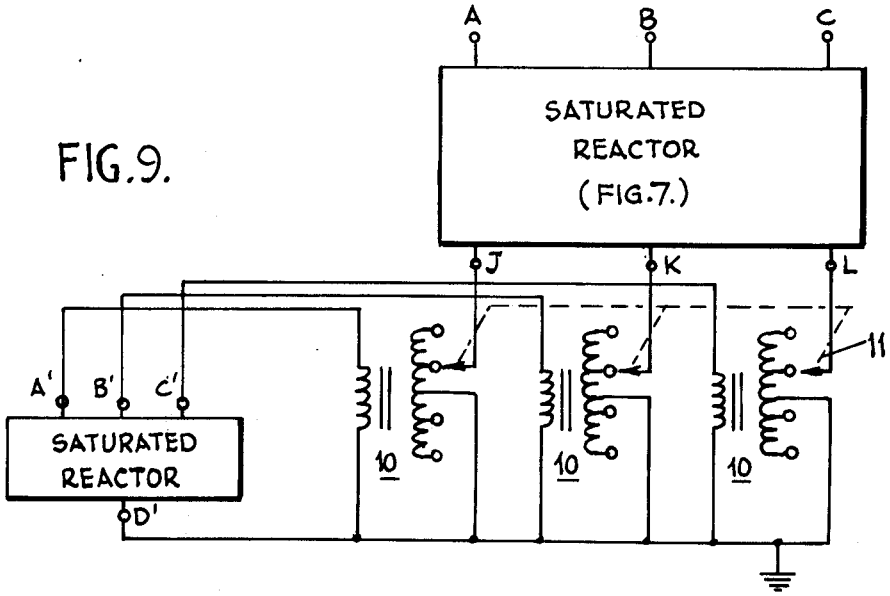

In another application, shown in FIG. 9, a relatively small additional saturated reactor 12, preferably of a similar number of limbs to the main reactor, and of the basic form shown in FIG. 2, is connected via a transformer 10 and tapchanger 11. By variation of the tap position the intercept voltage $E_0$ may be increased from zero to an amount depending on the voltage of the small reactor 12 and the ratio of its transformer 10.

Figure 4:
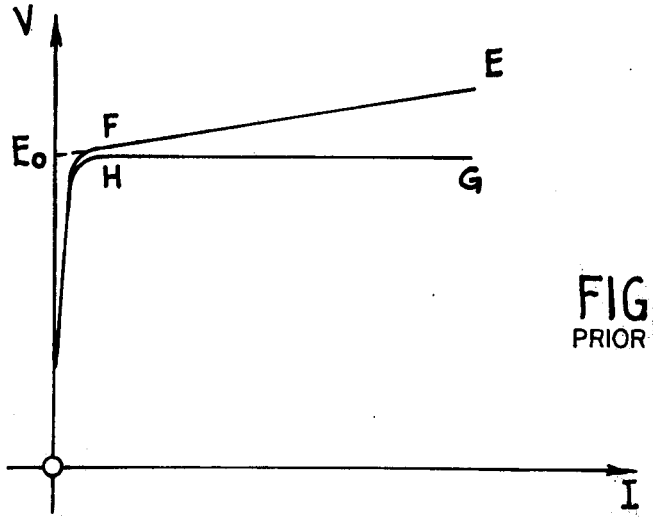
FIG. 4. PRIOR ART
FIG. 4 is a typical voltage/current characteristic of a saturated reactor.

For some applications the finite slope EF in FIG. 4 (typically 12% to 15%) may be satisfactory; however in other applications a lower slope of, preferably, zero is desirable to improve voltage stabilisation. This may be achieved in a known manner (for example, as described in U.S. Pat. No. 3,450,981 or U.S. Pat. No. 3,881,137) by the addition of a capacitor in series with each saturated reactor connection, of a capacitive impedance equal in magnitude to the reactive impedance corresponding to slope EF. This gives the complete characteristic GHO for positive-sequence currents, having region GH of zero slope.

Figure 10:
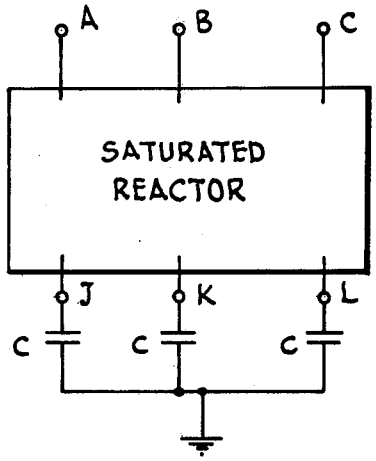

When series capacitors are similarly used with a reactor according to the present invention they are preferably inserted in the low voltage end of the reactor as shown in FIG. 10. The positive-sequence characteristic is then unchanged, as GHO, but the overall zero-sequence reactance may become negative (i.e. capacitive) since it is difficult in design to avoid the zero-sequence reactance of the saturated reactor being lower than its positive-sequence reactance.

Figure 11:
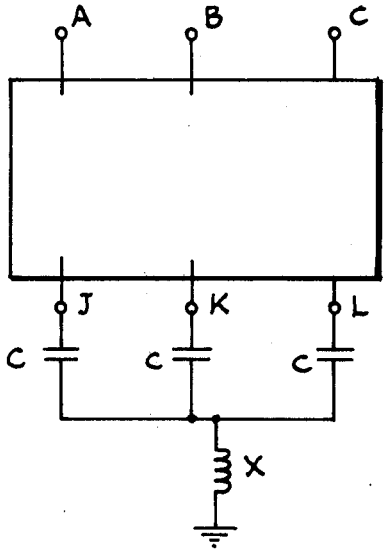

This may in some conditions cause difficulties in system operation, and in this case a single external linear reactor may be inserted additionally in the neutral connection as shown in FIG. 11, of a relatively low reactance X choosen so that the total reactance is substantially zero to both positive and zero-sequences. A larger value of X than this minimum value may be used if a finite total inductive zero-sequence reactance is required, for example to reduce fault currents as mentioned previously.

Figure 12:
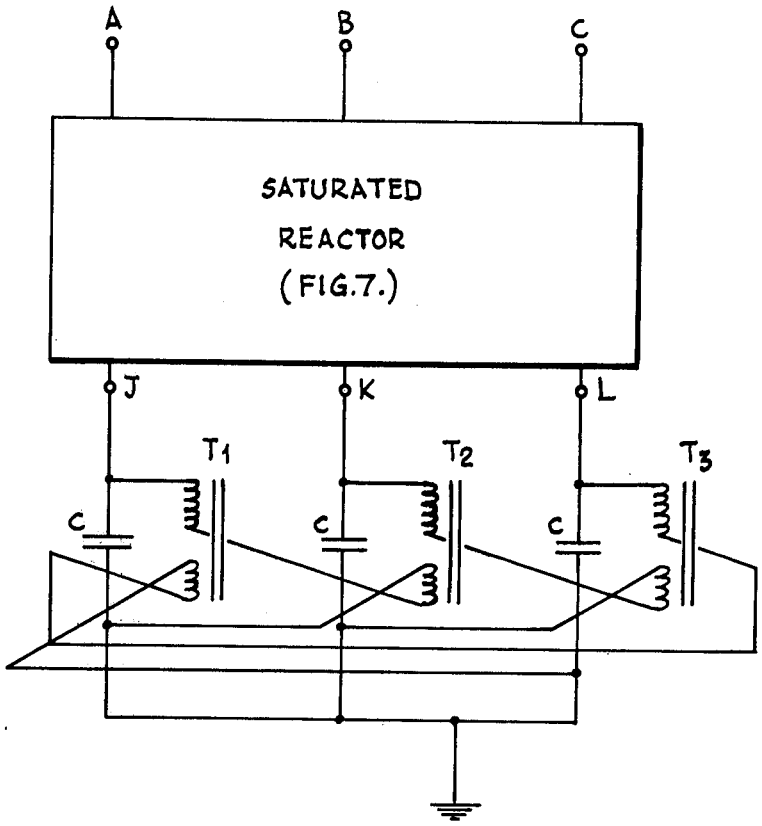

FIG. 12 shows another method in which advantage is taken of saturable protection reactors $T_1$, $T_2$, $T_3$, which are often connected across series capacitors to limit their overvoltage, by adding extra windings and connecting them in a zig-zag manner. For normal positive or negative sequence currents the reactors $T_1$, $T_2$, $T_3$ are energised normally and draw negligible current. For a zero sequence current component the combination of $T_1$, $T_2$, $T_3$ effectively presents its leakage reactance only across each capacitor; this is sufficiently low as to substantially short-circuit the capacitors to zero sequence current, and hence provides an effectively inductive overall reactance to zero-sequence currents.

I claim:

1. A saturated reactor arrangement having three line-terminals and a star-point, for providing a reactive load with negligible zero-sequence reactance and the capability of earthing said star-point without reducing harmonic compensation, said reactor arrangement being of the kind comprising:

A. a core structure having *n* core-limbs,
  I. where *n* is at least five,
  II. said *n* core-limbs being in *p* groups where *p* is at least one and where *n/p* is an integer, B. each of said *p* groups having primary windings connected between said three line-terminals and said star-point,
  I. the primary windings of each group being connected in series with the primary windings of each other group if any, and in such manner that fluxes in said core-limbs have phases spaced regularly throughout each half cycle for effecting harmonic current cancellation, C. the reactor arrangement further comprising a secondary winding on each of said *n* core-limbs,
  I. each said secondary winding being interconnected with each other secondary winding to form at least one mesh circuit, wherein the improvement comprises:

D. constituting the primary windings of
  I. one set of two duplicate sets of primary winding components having said core structure in common,
  II. said two duplicate sets being connected in zig-zag star connection between said three line-terminals and said star-point to prevent any net magnetization of said core-limbs by zero-sequence current.

2. A saturated reactor arrangement according to claim 1 wherein a compensating saturated reactor is connected to said secondary windings for extending the range of suppressed harmonic currents.

3. A saturated reactor arrangement according to claim 1 wherein duplicate components of said primary windings, which components are on the same supply phase and on the same core-limb, are combined in a single winding.

4. A saturated reactor arrangement according to claim 1 wherein the core-limbs have entirely ferromagnetic flux paths.

5. A saturated reactor arrangement according to claim 1 comprising a neutral terminal and an impedance connected between said star-point and said neutral terminal for limiting earth fault currents.

6. A saturated reactor arrangement according to claim 1 in which said primary windings are connected to said star-point by three star-point connections, and a controllable 3-phase reactive voltage supply device is connected between said three star-point connections and said star-point for biasing the voltage level of the saturated reactor characteristic.

7. A saturated reactor arrangement according to claim 6 wherein said reactive voltage supply device comprises a 3-phase transformer and a tap-changer for adjusting the ratio thereof.

8. A saturated ractor arrangement according to claim 6 wherein said reactive voltage supply device is a further saturated reactor arrangement of the kind comprising a core structure having $n$ core-limbs, where $n$ is at least five, said $n$ core-limbs being in $p$ groups where $p$ is at least one and where $n/p$ is an integer, each of said $p$ groups having primary windings connected between three line-terminals and a star-point, the primary windings of each group being connected in series with the primary windings of each other group if any, and in such manner that fluxes in said core-limbs have phases spaced regularly throughout each half cycle for effecting harmonic current cancellation, the reactor arrangement further comprising a secondary winding on each of said $n$ core-limbs, each said secondary winding being interconnected with each other secondary winding to form at least one mesh circuit.

9. A saturated reactor arrangement according to claim 1 including a capacitor connected in series with each set of said primary windings for modification of the effective saturated slope reactance.

10. A saturated reactor arrangement according to claim 9 and comprising three saturable reactors each having two windings connected in zig-zag between the phases, said saturable reactors short-circuiting said capacitors in respect of zero-sequence currents.

* * * * *